US006938604B2

(12) United States Patent
Gabriel et al.

(10) Patent No.: US 6,938,604 B2
(45) Date of Patent: Sep. 6, 2005

(54) COOLING CHANNEL COVER FOR A ONE-PIECE PISTON OF AN INTERNAL COMBUSTION ENGINE

(75) Inventors: Dieter Gabriel, Highland, MI (US); Michael T. Lapp, Bloomsfield, MI (US)

(73) Assignee: Mahle GmbH, Stuttgart (DE)

( * ) Notice: Subject to any disclaimer, the term of this patent is extended or adjusted under 35 U.S.C. 154(b) by 10 days.

(21) Appl. No.: 10/679,602

(22) Filed: Oct. 6, 2003

(65) Prior Publication Data

US 2005/0072387 A1 Apr. 7, 2005

(51) Int. Cl.[7] ..... F02F 3/00
(52) U.S. Cl. ..... 123/193.6
(58) Field of Search ..... 123/193.6, 41.01, 123/41.35, 41.34, 193.5

(56) References Cited

U.S. PATENT DOCUMENTS

| | | | | | |
|---|---|---|---|---|---|
| 2,687,931 | A | * | 8/1954 | Flynn, Jr. | 92/186 |
| 3,221,718 | A | * | 12/1965 | Isley | 123/41.35 |
| 3,906,924 | A | * | 9/1975 | Elsbett | 123/193.6 |
| 4,120,081 | A | * | 10/1978 | Rosch et al. | 29/888.045 |
| 5,052,280 | A | * | 10/1991 | Kopf et al. | 92/186 |
| 5,144,923 | A | | 9/1992 | Leites et al. | |
| 5,261,363 | A | * | 11/1993 | Kemnitz | 123/193.6 |
| 5,357,920 | A | * | 10/1994 | Kemnitz et al. | 123/193.6 |
| 5,394,819 | A | | 3/1995 | Aarnio | |
| 5,778,533 | A | | 7/1998 | Kemnitz | |
| 6,105,540 | A | * | 8/2000 | Bing et al. | 123/41.35 |
| 6,659,062 | B1 | * | 12/2003 | Issler | 123/193.6 |
| 6,701,875 | B2 | * | 3/2004 | Weng et al. | 123/41.35 |
| 6,820,582 | B1 | * | 11/2004 | Gabriel et al. | 123/193.6 |

FOREIGN PATENT DOCUMENTS

| | | | | |
|---|---|---|---|---|
| DE | 252 638 | | 12/1987 | |
| DE | 41 34 530 | | 5/1992 | |
| DE | 40 39 751 | | 6/1992 | |
| DE | 42 08 037 | | 3/1998 | |
| EP | 0 561 871 | | 11/1995 | |
| EP | 0 799 373 | | 1/1999 | |
| JP | 04109065 | A * | 4/1992 | F02F/3/00 |

OTHER PUBLICATIONS

International Standard ISO 1043–1 dated 1997.

* cited by examiner

*Primary Examiner*—Henry C. Yuen
*Assistant Examiner*—Jason Benton
(74) *Attorney, Agent, or Firm*—Collard & Roe, P.C.

(57) ABSTRACT

A cooling channel cover for a one-piece piston of an internal combustion engine, the piston having a closed cooling channel that runs around inside the piston crown, at the level of the piston ring band, and a ring-shaped recess provided between the piston ring band and the piston shaft, wherein the piston shaft is connected with the piston hubs suspended on the piston crown. In such a piston, an easy to assemble cooling channel cover is achieved in that a one-piece, plastic spring steal ring, U-shaped in cross-section, having radially angled outer and inner shanks around the circumference, has at least one film hinge running around the circumference of the ring. The film hinge allows at least one radial deflection of at least one of the shanks, in such a manner that in order to close off the cooling channel, the shanks engage in a stepped conical recess on the inner edge of the cooling channel.

14 Claims, 1 Drawing Sheet

COOLING CHANNEL COVER FOR A ONE-PIECE PISTON OF AN INTERNAL COMBUSTION ENGINE

BACKGROUND OF THE INVENTION

1. Field of the Invention

The invention relates to a cooling channel cover for a one-piece piston of an internal combustion engine, having a closed cooling channel that runs around inside the piston crown, at the level of the piston ring band, and a ring-shaped recess provided between the piston ring band and the piston shaft, wherein the piston shaft is connected with the piston hubs suspended on the piston crown.

2. The Prior Art

A multi-part cooled piston having a cooling channel arranged in the edge region of the piston head is known from German Publication No. DE 40 39 751 A1, which channel is covered with a sheet-metal ring essentially structured like a cup spring. This sheet-metal ring is structured in one piece and can be easily assembled with the piston only because the piston is structured in two parts. It is necessary to assemble the sheet-metal ring with the upper piston part first, before the upper piston part is connected with the lower piston part.

Furthermore, pistons are known from German Publication No. DD 252 638 A1 and German Publication No. DE 41 34 530 A1, in which a wall part that covers the cooling channel that is open to the bottom, and runs around the circumference in ring shape, is structured as an open sheet-metal ring, which rests in a groove against the inside circumference of the piston ring zone, and against the outside circumference of the combustion chamber wall, respectively, taking advantage of its plastic deformation according to the Seeger ring principle, i.e. biased in the radial direction.

Furthermore, a multi-part piston having a cooling channel is known from German Patent No. DE 42 08 037 C2, in which the cooling channel, which is open to the bottom, is covered by a biased cup spring, which is divided into at least two parts on its circumference, and rests freely on supports against axially opposite sides, radially on the inside and the outside.

Finally, one-piece cooling channel pistons having a cooling channel arranged in the edge region of the piston head are known from European Patents Nos. EP 0 561 871 B1 and EP 0 799 373 B1, which channel is also closed off with cover rings structured like cup springs, or cover rings structured like cup springs and provided with a collar.

A disadvantage of the aforementioned embodiments is that the cover ring or cup spring must be structured in two parts, in order to be able to be assembled. Furthermore, during assembly each of the two semi-circular ring halves must be individually introduced into corresponding bearings on the piston crown, in the biased state.

SUMMARY OF THE INVENTION

It is therefore an object of the invention to create a cooling channel cover for a one-piece piston of an internal combustion engine, which cover can be installed easily and quickly, and wherein piston weight is reduced as compared with the known state of the art.

This object is accomplished by means of a one-piece, U-shaped plastic spring steal ring, provided with radially angled outer and inner shanks around the circumference. The ring has at least one film hinge around the circumference that allows at least one radial deflection of at least one of the shanks, in such a manner that in order to close off the cooling channel, the shanks engage in a stepped conical recess on the inner edge of the cooling channel. The film hinge is preferably located on the radially outer or radially inner shank of the U-shaped ring and is formed by a weakening of material at an angle of the shanks from the ring bottom. The ring is preferably made of polyphenylene sulfide (PPS) or a polyimide (PI) or a carbon spring steal.

The recesses in the cooling channel preferably form conically shaped walls in an axial piston direction, against which the radially outer and inner shanks rest, under slight bias, in an assembled state of the U-shaped ring. The outer shank is preferably arranged on an outside circumference of the piston crown and is angled radially outward with respect to a crosswise axis of the piston, and the inner shank is preferably arranged on an inside circumference of the piston crown and is angled radially inward with respect to the crosswise axis of the piston.

In a preferred embodiment, slits that extend close to the ring bottom are made in the radially outer and radially inner shanks. The slits are non-uniformly distributed over the circumference of the ring, in order to produce a plurality of shanks having different ridge lengths. The slits preferably have a width of 2 to 3 mm and the ridge lengths are preferably 15 to 20 mm.

The U-shaped ring is preferably radially divided in such a way that a mouth width is formed, forming a cooling oil inlet or a cooling oil outlet for the cooling channel.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
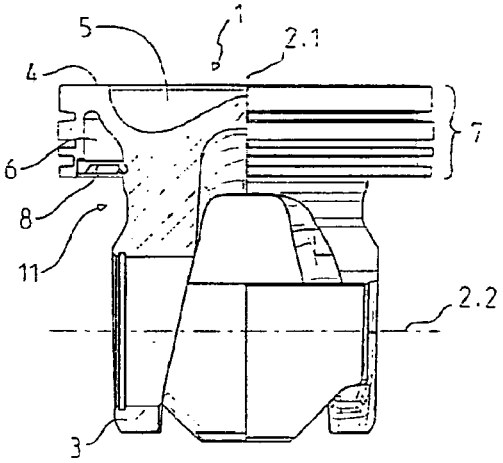
FIG. 1 shows a one-piece piston for an internal combustion engine, having a cooling channel closed off by a U-shaped ring according to the invention, shown in a cross-sectional diagram that consists of two halves, which shows two longitudinal cross-sections of the piston, offset by 90°.
Figure 2:
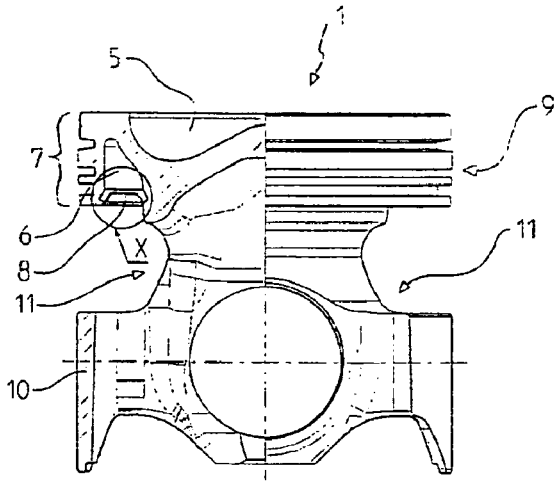
FIG. 2 shows a piston according to FIG. 1, rotated by 90°.
Figure 3:
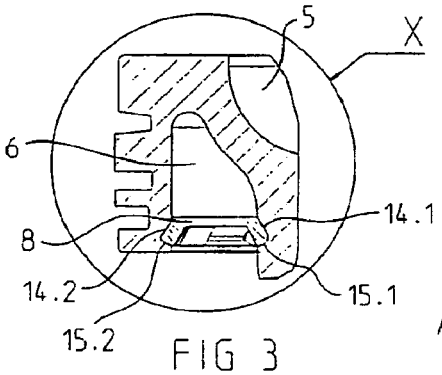
FIG. 3 shows a partial detail of the piston according to Detail X from FIG. 2.

Referring now in detail to the drawings, FIG. 1 shows a piston 1, structured in one piece, for an internal combustion engine, in a cross-sectional diagram that consists of two halves, the left half representing a cross-section of piston 1 along a longitudinal axis 2 of the piston, and the right half representing a longitudinal axis of piston 1 that is offset from the former by 90°.

Piston 1 is made of steel and has a piston crown 9 having a piston ring band 7 and a piston head 4 having a combustion space depression 5, whereby a piston shaft 10 is connected with piston hubs 3 suspended on the piston crown. At the level of piston ring band 7, a closed cooling channel 6 that runs around the circumference in a ring shape is arranged in piston crown 9, the radial outer delimitation and radial inner delimitation of which channel are determined by the ring wall molded onto piston head 4 and by the piston crown region on which piston hubs 3 are suspended. The inside of cooling channel 6 has a recess 14.2 on the ring wall side and a recess 14.1 on the piston crown side, the wall regions of which result in a conically narrowed shape in the axial direction, towards piston head 4. The incline, in each instance, is characterized by the angle between the axial piston axis 2.1 and the slant of the recess wall, which is approximately 30°. The recesses 14.1 and 14.2 are delimited by a step 15.1 and 15.2, in each instance, which also result in a conically narrowed shape in the direction towards the piston shaft 10, and whose aforementioned defined angle has a value of approximately 20 to 30°.

A ring-shaped recess 11 is provided between piston ring band 7 and piston shaft 10, by means of which assembly for closing off cooling channel 6 by means of a one-piece plastic spring steal ring 8, U-shaped in cross-section, takes place. According to the invention, an elastic plastic, particularly from the group of polyphenylene sulfides (abbreviation: PPS), for example Ryton R4®, is used for this purpose. In another embodiment of the invention, a plastic from the group of high-temperature polyimides (abbreviation: PI), such as VESPEL® from DuPont or AURUM® from Mitsui Chemicals Inc., can also be used for this purpose. Such elastic plastics are characterized by their resistance to high temperatures, i.e. heat, of 200° C. to over 400° C. in long-term operation. In addition, these plastics can also be fiber-reinforced. The abbreviations correspond to the international standard ISO 1043-1 dated 1997.

The spring steal can be a steal. Carbon steal like ck 75. Tempering is optional.

Figure 4:
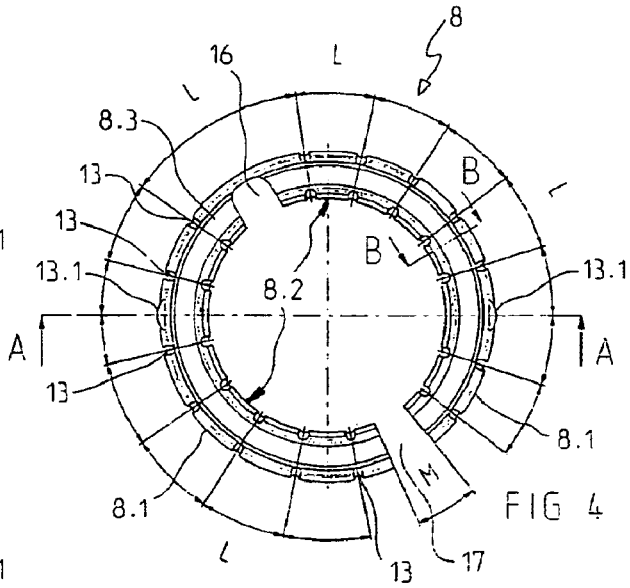
FIG. 4 shows a top view of the U-shaped ring.

According to FIG. 4, U-shaped plastic ring 8 has a radial outer shank 8.1 angled away from its ring bottom 8.3, and a radial inner shank 8.2 angled away from ring bottom 8.3. The shanks are divided by slits 13 non-uniformly distributed over the circumference, so that shank segments L of different lengths are formed. The slits are made down close to the bottom 8.3 of plastic ring 8 and have a slightly V-shaped form and a slit width of 2 to 3 mm. The aforementioned radial slitting takes place distributed over the circumference of the ring, preferably in an angle range between 15 and 25°.

Figure 6:
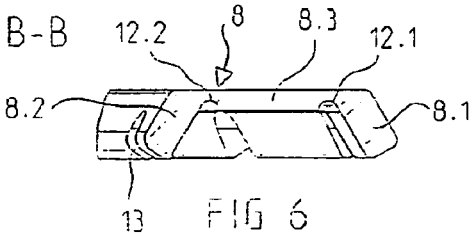
FIG. 6 shows a cross-section along the line B—B of the U-shaped ring according to FIG. 4.
Figure 5:
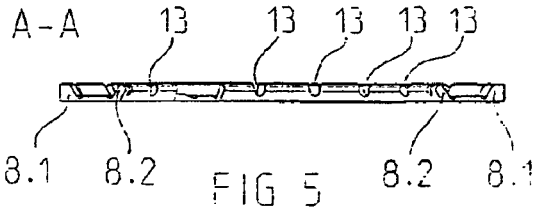
FIG. 5 shows a cross-section along the line A—A of the U-shaped ring according to FIG. 4.

As shown in the cross-sectional diagram according to FIG. 6, the outer shank 8.1 is arranged on the outside circumference of the ring bottom 8.3, and angled off radially to the outside with reference to the crosswise axis 2.2 of the piston, from the ring bottom 8.3, whereby the inner shank 8.2 is angled off radially towards the inside, and is arranged on the inside circumference of the piston bottom 8.3. So-called film hinges 12.1 and 12.2 around the circumference are made in the inside angles of shanks 14.1 and 14.2 of the ring bottom 8.3, which hinges are formed by a weakening of the material around the circumference of plastic ring 8. According to another embodiment of the invention, such a film hinge can also be arranged only on radially outer shank 8.1 or radially inner shank 8.2 of the U-shaped plastic ring 8.

As is evident from FIG. 4, U-shaped plastic ring 8 is radially divided in such a way that an opening 17 with a mouth width M is formed. At 180° opposite to this there is a U-shaped opening 16 having approximately the same width. Both openings 16 and 17 serve as the oil inlet and oil outlet, respectively, in the assembled state of plastic ring 8, to supply cooling channel 6 with oil.

Assembly of ring 8 can take place in a simple manner, in that it is bent up, on half its side, from its plane, up to a level that corresponds to the axial height of recess 11, introduced into recess 11, and pushed over the hub region suspended on the piston crown. In this pre-assembled state, the ring is oriented towards the piston head with its ring bottom 8.3. Despite the use of a relatively inelastic plastic, bending the ring in half, out of the drawing plane according to FIG. 4, is made possible without destruction because bending of ring 8 takes place at or above opening 16, and thereby at a reduced ring material width. With regard to the use of a plastic made of polyphenylene sulfide (PPS) or a high-temperature polyimide (PI), there are no assembly problems, due to the elasticity of the materials.

In order to close off cooling channel 6, ring 8 is subsequently pressed over steps 15.1 and 15.2, so that its shanks 8.1 and 8.2 come to rest on recesses 14.1 and 14.2, whereby the faces of the shanks are supported on the steps. The radial deflection of shanks 8.1 and 8.2 is made possible, according to the invention, by the film hinges 12.1 and 12.2. Two projections 13.1 that are arranged on the circumference opposite the outer shank 8.1, and engage in recesses in the cooling channel, not shown, serve to prevent the U-shaped ring from rotating out of place.

Accordingly, while only a few embodiments of the present invention have been shown and described, it is obvious that many changes and modifications may be made thereunto without departing from the spirit and scope of the invention.

REFERENCE SYMBOL LIST

1 piston
2.1 longitudinal piston axis
2.2 crosswise piston axis
3 piston hubs
4 piston head
5 combustion space depression
6 cooling channel
7 piston ring band
8 U-shaped ring
8.1 radially outer shank
8.2 radially inner shank
8.3 ring bottom
9 piston crown
10 shaft
11 ring-shaped recess
12 film hinge
12.1 film hinge of the radially outer shank
12.2 film hinge of the radially inner shank
13 slits
13.1 projections
14.1/14.2 circumferential recess
15.1/15.2 steps
16 cooling oil inlet
17 cooling oil outlet
L ridge length
M mouth width

What is claimed is:

1. A cooling channel cover for a one-piece piston of an internal combustion engine, the piston having a closed cooling channel that runs around inside a piston crown, at the level of a piston ring band, and a ring-shaped recess provided between the piston ring band and the piston shaft, wherein the piston shaft is connected with the piston hubs suspended on the piston crown, the cooling channel comprising a one-piece, plastic ring having the following features:

a U-shaped cross-section;

radially angled outer and inner shanks disposed around a circumference of the ring;

at least one film hinge running around the circumference of the ring, wherein the film hinge allows at least one radial deflection of at least one of the shanks, in such a manner that the shanks are adapted to engage in a stepped conical recess on an inner edge of the cooling channel in order to close off the cooling channel.

2. The cooling channel cover for according to claim 1, wherein the at least one film hinge is located on the radially outer or radially inner shank of the U-shaped ring, wherein the film hinge is formed by a weakening of material at an angle of the shanks from a ring bottom.

3. The cooling channel cover according to claim 1, wherein slits that extend close to the ring bottom are made in the radially outer and radially inner shanks, said slits being non-uniformly distributed over the circumference, in order to produce a plurality of shanks having different ridge lengths.

4. The cooling channel cover according to claim 3, wherein the slits have a width of 2 to 3 mm and the ridge lengths are 15 to 20 mm.

5. The cooling channel cover according to claim 1, wherein the U-shaped ring is radially divided in such a way that a mouth width is formed, said mouth width forming a cooling oil inlet or a cooling oil outlet for the cooling channel.

6. The cooling channel cover according to claim 1, wherein the U-shaped ring is made of polyphenylene sulfide (PPS) or a polyimide (PI).

7. A one-piece piston of an internal combustion engine, comprising:

a piston crown:

a closed cooling channel that runs around inside the piston crown, at the level of a piston ring band;

a piston shaft connected with the piston crown via hubs suspended on the piston crown;

a ring-shaped recess provided between the piston ring band and the piston shaft; and a cooling channel cover comprising a one-piece, plastic ring having the following features:

a U-shaped cross-section, radially angled outer and inner shanks around a circumference of the ring;

at least one film hinge running around the circumference of the ring, wherein the film hinge allows at least one radial deflection of at least one of the shanks, in such a manner that in order to close off the cooling channel, the shanks engage in a stepped conical recess on an inner edge of the cooling channel.

8. The piston according to claim 7, wherein the at least one film hinge is located on the radially outer or radially inner shank of the U-shaped ring, and wherein the film hinge is formed by a weakening of material at an angle of the shanks from a ring bottom.

9. The piston according to claim 7, wherein the recesses form conically shaped walls in an axial piston direction, against which the radially outer and inner shanks rest, under slight bias, in an assembled state of the U-shaped ring.

10. The piston according to claim 7, wherein the outer shank is arranged on an outside circumference of the piston crown and is angled radially outward with respect to a crosswise axis of the piston, and wherein the inner shank is arranged on an inside circumference of the piston crown and is angled radially inward with respect to the crosswise axis of the piston.

11. The piston according to claim 10, wherein slits that extend close to the ring bottom are made in the radially outer and radially inner shanks, said slits being non-uniformly distributed over the circumference of the ring, in order to produce a plurality of shanks having different ridge lengths.

12. The piston according to claim 11, wherein the slit has a width of 2 to 3 mm and the ridge lengths are 15 to 20 mm.

13. The piston according to claim 7, wherein the U-shaped ring is radially divided in such a way that a mouth width is formed, said mouth width forming a cooling oil inlet or a cooling oil outlet for the cooling channel.

14. The piston according to claim 7, wherein the U-shaped ring is made of polyphenylene sulfide (PPS) or a polyimide (PI), or a carbon spring steal.

* * * * *